US005100362A

United States Patent [19]

Fogarty et al.

[11] Patent Number: 5,100,362

[45] Date of Patent: Mar. 31, 1992

[54] PROPELLABLE ARTICULATING ANIMAL TOY

[76] Inventors: A. Edward Fogarty; Bonnie R. Fogarty, both of 39 Sandy Hook Rd., Sarasota, Fla. 34242

[21] Appl. No.: 621,595

[22] Filed: Dec. 3, 1990

[51] Int. Cl.[5] ..... A63H 5/00; A63H 17/25; A63H 3/31

[52] U.S. Cl. ..... 446/272; 446/270; 446/287; 446/189

[58] Field of Search ..... 446/189, 180, 190, 192, 446/268, 269, 270, 272, 273, 274, 275, 276, 277, 278, 279, 280, 285, 287, 288, 289, 292

[56] References Cited

U.S. PATENT DOCUMENTS

| | | | |
|---|---|---|---|
| 387,542 | 8/1888 | Rooker | 446/272 X |
| 1,105,652 | 8/1914 | Hall | 446/272 |
| 1,332,822 | 3/1920 | Fermier | 446/287 |
| 1,338,449 | 4/1920 | Herzog | 446/272 |
| 1,576,972 | 3/1926 | Higuchi | 446/285 |
| 2,410,646 | 11/1946 | Finn et al. | 446/272 |
| 2,709,601 | 5/1955 | Goerditz | 446/280 X |
| 2,983,072 | 5/1961 | Crawford et al. | 446/189 |
| 3,083,504 | 1/1963 | Abbott | 446/291 |
| 3,130,518 | 3/1964 | Glass et al. | 446/293 |
| 3,163,960 | 4/1965 | Iwaya et al. | 446/272 |
| 3,346,990 | 10/1967 | Holt | 446/274 |
| 3,492,759 | 11/1970 | Lewis et al. | 446/269 |
| 3,514,896 | 11/1970 | Neufeld | 446/290 |
| 3,566,533 | 3/1971 | Dunn et al. | 446/287 |
| 3,760,532 | 9/1973 | Campion | 446/289 |
| 4,292,759 | 10/1981 | Nagode | 446/289 |
| 4,329,809 | 4/1982 | Reece | 446/280 |
| 4,626,223 | 6/1986 | Sweet | 446/279 |
| 4,655,725 | 7/1987 | Torres | 446/246 |
| 4,662,856 | 5/1987 | Getget et al. | 446/280 |
| 4,693,697 | 9/1987 | Pagano | 446/272 |

FOREIGN PATENT DOCUMENTS

| | | | |
|---|---|---|---|
| 708701 | 7/1941 | Fed. Rep. of Germany | 446/288 |
| 525904 | 9/1940 | United Kingdom | 446/279 |
| 771381 | 4/1957 | United Kingdom | 446/285 |

*Primary Examiner*—David N. Muir
*Attorney, Agent, or Firm*—Charles J. Prescott

[57] ABSTRACT

A propellable articulating animal toy having a flexible, pliable stuffed body which simulates an animal, preferably a puppy, having freely moveable body components. The body fits over a housing which includes at least one ground-engaging support wheel connected within the housing. The housing also includes a forwardly extending lever pivotally mounted in the housing and structured to be pivotally articulated up and down through an acute angle by eccentric driving engagement with the wheel as the toy is manually propelled over a flat surface. The animal body also covering the lever is thus made to bob up and down appearing to be running or jumping as the toy is propelled over the flat surface. Although only the forwardly portion of the animal body is articulated by the pivoting movement of the lever, the entire body and all body components take on a realistic running motion due to the pliable nature of the animal body and its plush covering, which may also be made removable for holding and cuddling. A bellows may also be included which produces a sound similar to that of the particular animal such as the bark of a dog. The bellows is operably moved by the interior portion of the lever so as to produce a sound coincident with the running motion. The preferred embodiment includes a rearwardly and upwardly extending push handle for propelling the toy across the ground and a detachable leash to add to the realism of the toy.

11 Claims, 3 Drawing Sheets

PROPELLABLE ARTICULATING ANIMAL TOY

BACKGROUND OF THE INVENTION

This invention relates generally to toys, and more particularly to a propellable articulating animal toy which simulates in realistic fashion the movement of a running or jumping animal.

Children enjoy the companionship of animals or pets. Dogs and puppies are extremely popular pets and the activity of taking a dog for a walk on a leash is particularly satisfying. Likewise, holding and cuddling a realistic stuffed toy animal is quite enjoyable.

A number of devices are known in prior art which have attempted to provide a toy which realistically simulates an animal such a dog or puppy in a walking motion across the ground. One such device is disclosed in U.S. Pat. No. 3,760,532 to Champion which discloses a push-type toy having animated head and tail. However, full realism is lacking in this device.

Another such device is disclosed in U.S. Pat. No. 4,693,697 to Pagano which teaches a push-pull toy in the form of a turtle having an animated head as it is rolled across the ground. Another such device is disclosed in U.S. Pat. No. 4,662,856 to Getgey which is in the form of a rollably propellable animated toy which eccentrically moves by a cam mechanism the top of a plush fabric cover.

A push-pull wheeled action toy is disclosed in U.S. Pat. No. 4,292,759 to Nagode in which the head of the device is made to bob up and down by rotating internal wheel-driven fins or cams.

The wheeled, eccentrically driven invention to Dunn disclosed in U.S. Pat. No. 3,566,533 articulates a platform in alternate opposing areas so as to animate one of two toy figurines on the platform.

Other less closely related animated toys are also known to applicant as follows: U.S. Pat Nos.

Torres: 4,655,725
Sweet: 4,626,223
Reece: 4,329,809
Neufeld: 3,514,896
Lewis, et al.: 3,492,759
Glass, et al.: 3,130,518
Iwaya, et al.: 3,163,960
Abbott: 3,083,504

The present invention provides a child with a soft, cuddly animal such as a puppy which may be both taken for a very realistic walk and then removed from the housing for cuddling and as a night-time bed companion. The present invention also provides a manually propellable animal toy which produces extremely realistic running and jumping movement of the particular animal body as the toy is manually propelled across the ground.

BRIEF SUMMARY OF THE INVENTION

This invention is directed to a propellable articulating animal toy having a flexible, pliable stuffed body which simulates an animal, preferably a puppy, having freely moveable body components. The body fits over a housing which includes at least one ground-engaging support wheel connected within the housing. The housing also includes a forwardly extending lever pivotally mounted in the housing and structured to be pivotally articulated up and down through an acute angle by eccentric driving engagement with the wheel as the toy is manually propelled over a flat surface. The animal body also covering the lever is thus made to bob up and down appearing to be running or jumping as the toy is propelled over the flat surface. Although only the forwardly portion of the animal body is articulated by the pivoting movement of the lever, the entire body and all body components take on a realistic running motion due to the pliable nature of the animal body and its plush covering, which may also be made removable for holding and cuddling. A bellows may also be included which produces a sound similar to that of the particular animal such as the bark of a dog. The bellows is operably moved by the interior portion of the lever so as to produce a sound coincident with the running motion. The preferred embodiment includes a rearwardly and upwardly extending push handle for propelling the toy across the ground and a detachable leash to add to the realism of the toy.

It is therefore an object of this invention to provide a manually propelled articulating animal toy which is extremely realistic in body movement simulating jumping and running.

It is another object of this invention to provide a dual function animal toy which is both manually propellable across the ground as in walking a pet and which includes a life-like stuffed animal body which is detachable from the housing for cuddling and holding.

It is yet another object of this invention to provide a manually propellable articulated animal toy which very closely simulates the feeling of walking an active, life-like pet on a leash.

It is yet another object of this invention to provide for the easy removal of the animal body for laundering and cleaning.

In accordance with these and other objects which will become apparent hereinafter, the instant invention will now be described with reference to the accompanying drawings.

DETAILED DESCRIPTION OF THE INVENTION

Figures 1, 2, 3, 4:
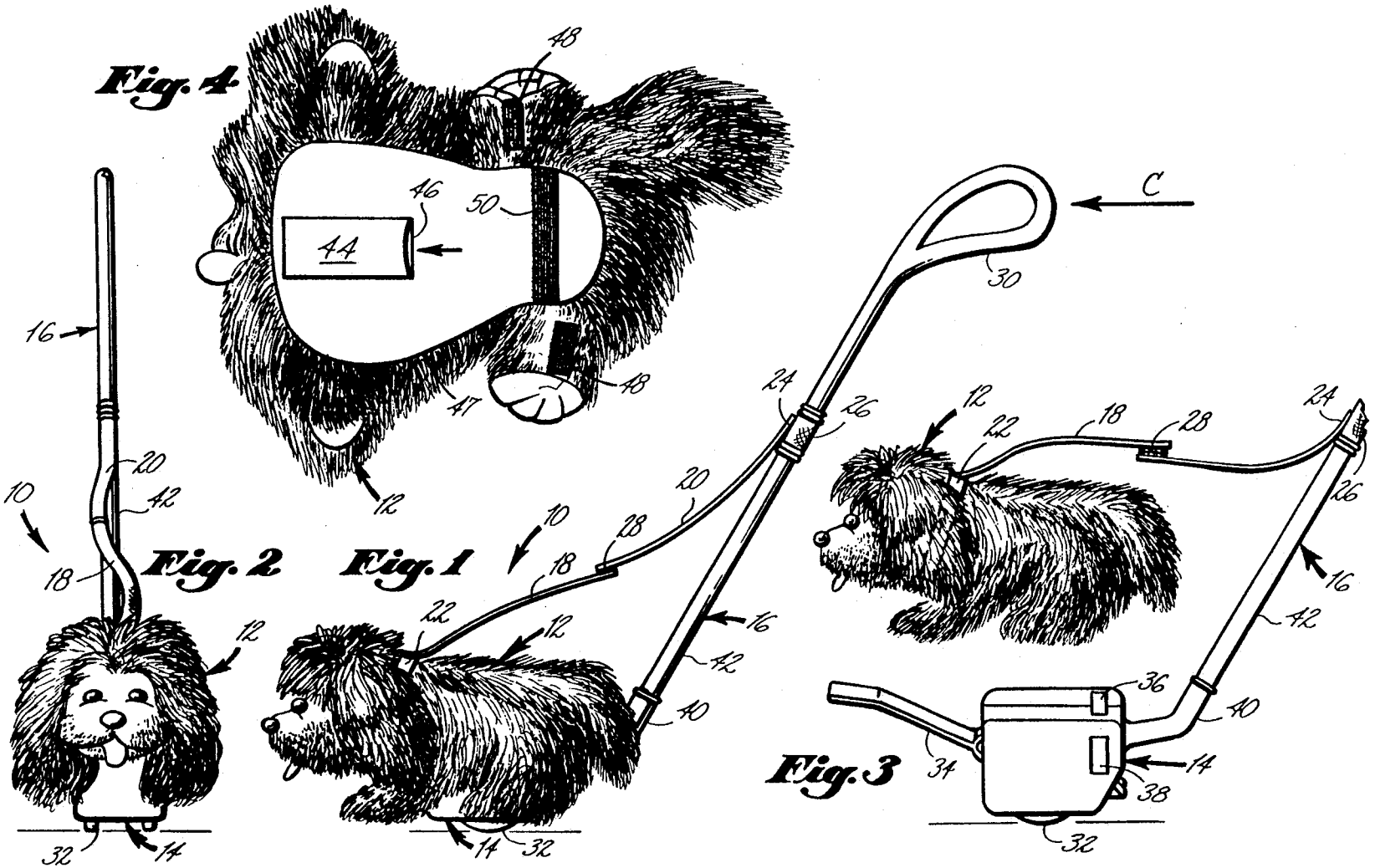
FIG. 1 is a side elevation view of the preferred embodiment of the invention.
FIG. 2 is a left end elevation view of FIG. 1.
FIG. 3 is a view similar to FIG. 1 showing the animal body removed from the housing.
FIG. 4 is a bottom plan view of the animal body shown in FIG. 1.

Referring now to the drawings, and firstly to FIGS. 1 to 4, the preferred embodiment of the invention is shown generally at numeral 10 and includes a stuffed, pliable, flexible animal body 12, a housing 14 and an elongated, rigid, slender molded plastic push handle 16. The animal body 12 is fabricated having a flexible fabric covering stuffed of conventional material and having long, plush simulated hair or fur over all of the exposed surface except for the bottom panel 47 as seen in FIG. 4.

The animal body 12 is sized so as to fit atop housing 14 which is fabricated of molded plastic halves and having a rearwardly extending handle support 40 and a pivotally connected forwardly extending articulating lever 34 which will be described more fully herebelow. The animal body 12 is detachably connectable over the housing 14 by mating two part VELCRO halves 36 and 38 on the housing 14 which mate with VELCRO strips 48 and 50 connected to the under body and inner paws of the animal body 12 which is preferably a dog or a puppy. Mating VELCRO strips 36/50 are optional. The exposed portion of lever 34 slidably fits into the open end 46 of pocket 44 sewn to fabric panel 47. Lever 34 is inserted into the open end 46 in the direction of the arrow.

Figures 5, 6, 11:
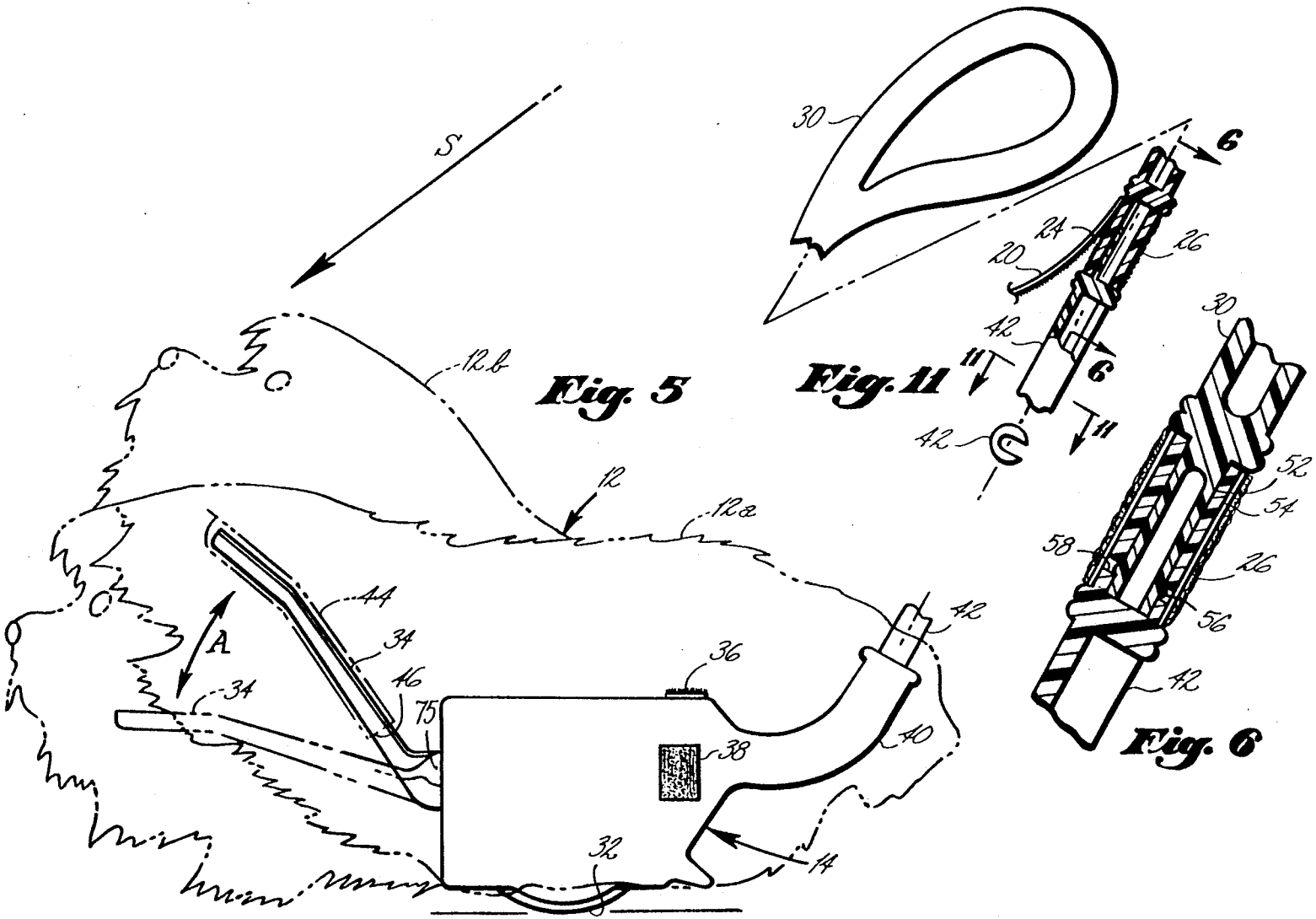
FIG. 5 is a side elevation view of the housing and handle portion of the invention showing the animal body in phantom.
FIG. 6 is a section view in the direction of arrows 6—6 in FIG. 11.
FIG. 11 is a section view in the direction of arrows 11—11 in FIG. 5.

The push handle 16 has its lower portion 42 connected within handle support 40 in a manner similar to that described with respect to FIG. 6 as will be herebelow described. Handle upper portion 30 includes a looped distal end for grasping and propelling the device 10 rollably across the ground in the direction of arrow C on a pair of wheels 32 mounted within the housing 40. A two-part leash having an upper portion 20 detachably connectable at 24 from the mid-portion of push handle 16 by mating two-part VELCRO and a lower portion 18 which is detachable from a collar 22 around the neck of the animal toy is also provided. The leash is segmented by detachable connection at its mid-portion 28 so as to reduce the length of any segment of the leash. Thus, the leash may be completely removed when the animal toy 12 is removed for cuddling and separate playing.

Referring to FIGS. 5 and 6, the upper and lower handle portions 30 and 42, respectively, are assembled having a VELCRO band 26 installed there around which is releasably attachable to the upper end 24 of leash portion 20. Alternately and preferably, a fabric band would replace the VELCRO band 26 and upper end 24 is sewn permanently to the fabric band. The two handle halves 30 and 42 are held together by molded protrusions 56 which snapably engage into mating apertures 58.

As seen in FIG. 5, the articulating lever 34 held within fabric pocket 44 pivotally moves up and down in the direction of arrow A about transverse axis 75 within housing 14. This arrangement is thus such that the entire forwardly portion **12*b* of animal toy 12 is influenced and made to articulate with lever 34. Because of the flexible, pliable structure of animal toy 12 is as previously described, the entire animal body 12, including its head, ears, legs and tail, are gyrated by this motion. The long plush fabric simulating hair is also animated so as to increase the realism of the body movement resulting from the pivotal articulation of lever 34. In its fully upward position of forward body portion 12*b*, the user which is grasping and pushing the looped upper handle 30** is able to see the face of the animal toy in the direction of sight line S.

Figures 7, 8, 9, 10:
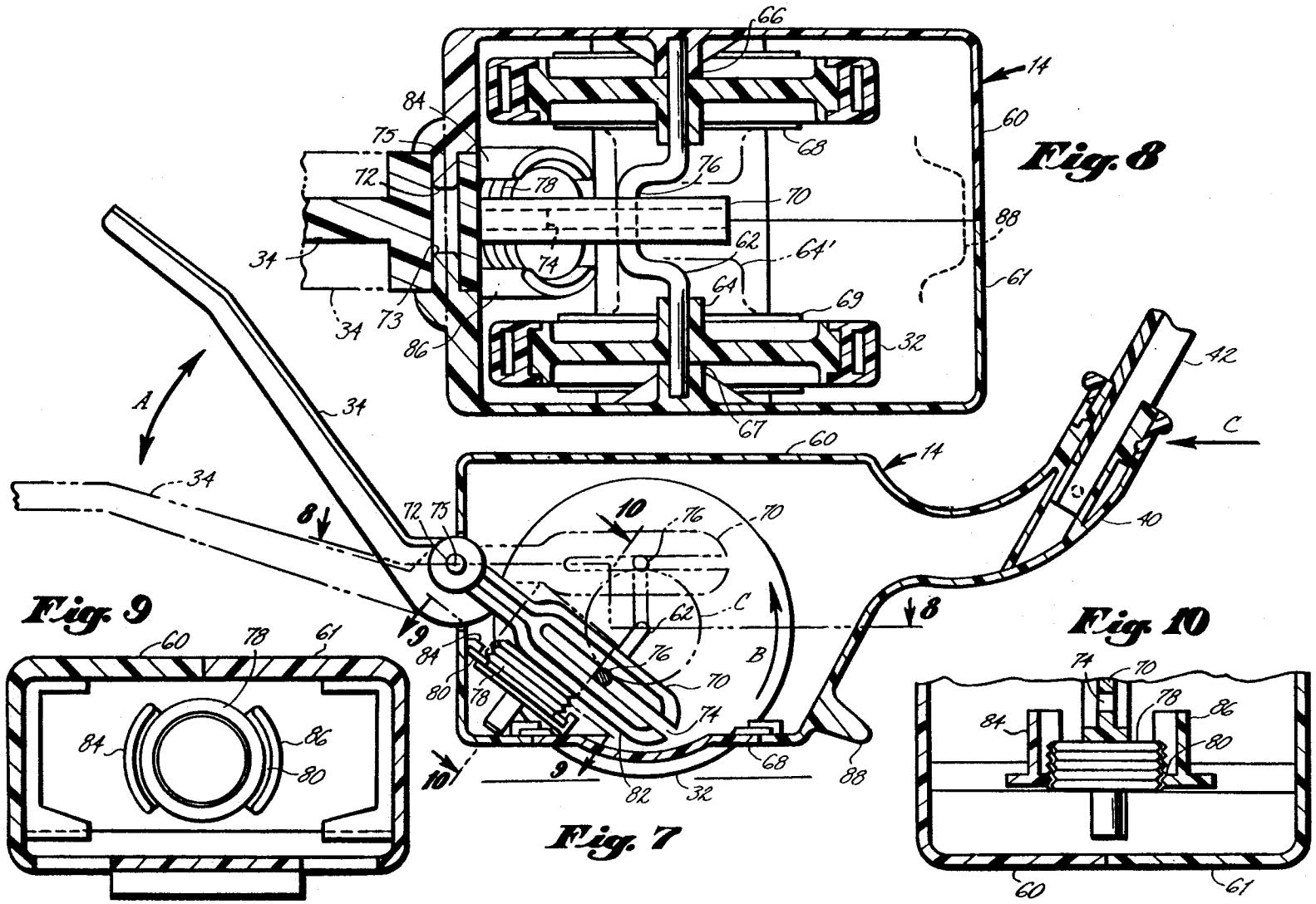
FIG. 7 is a longitudinal section view of the housing of the invention.
FIG. 8 is a section view in the direction of arrows 8—8 in FIG. 7.
FIG. 9 is a section view in the direction of arrows 9—9 in FIG. 7.
FIG. 10 is a section view in the direction of arrows 10—10 in FIG. 7.

Referring additionally to FIGS. 7, 8, 9 and 10, the detail of the housing 14 is there shown. The housing 14 includes molded mating plastic halves 60 and 61 which are mirror images one to another. Rotatably mounted within these halves 60 and 61 within bosses 66 and 67 is a transverse axle 62 having an eccentric central portion 76. A pair of spaced wheels 32 are mounted on integral hubs 64 in driving engagement with each end of axle 62 as best seen in FIG. 8. The positioning of wheels 32 is such that they extend downwardly through apertures 68 and 69 for ground engagement.

Note alternately in FIG. 8 that the pair of wheels 32 and axle 62 may be integrally molded at 64' (in phantom) so as to provide the same eccentric 76 thus forming a single wheel assembly.

Lever 34 is pivotally connected within housing 14 on pins 72 and 73 about transverse axis 75 as best seen in FIG. 8. Thus, the majority of lever 34 is exposed and forwardly extends longitudinally from housing 14. Lever 34 also rearwardly extends at 70 into housing 14 so that slot 74 may slidably engage around eccentric portion 76 of axle 62. Thus, by this arrangement, as wheel 32 is rotated in the direction of arrow B, lever 34 pivotally articulates up and down in the direction of arrow A.

This angle A is preferably about forty degrees (40°) and generally extends from a lower, horizontal position to an upper position at an acute angle to the horizon. Of course, the interior portion 70 pivotally articulates in reverse angular fashion.

The preferred ratio as established by the diameter of wheel 32 between the frequency of pivotal oscillation of lever 34 and linear movement over a flat surface is about one cycle per linear foot. Thus, the preferred diameter of wheel 32 is in the range of 3.5 inches.

The preferred embodiment of housing 14 also includes a bellows 78 which is mounted within supports 84 and 86, held thusly at its lower end by ring 80. The upper end of bellows 78 is free floating and contacts the lower surface 82 of lever inner portion 70. Thus, bellows 78 articulates from a fully extended configuration shown in phantom in FIG. 7 to its fully compressed position shown in solid lines in that figure.

Bellows 78 is structured so as to produce an audible sound as it is extended and compressed which is similar to the characteristic noise made by the particular animal body selected. For instance, the bellows will make the sound of a barking puppy in the preferred embodiment as shown. Because the bellows 78 functions simultaneously with the articulation of lever 34, as the forwardly portion **12*b* of the animal body 12 is pushed upwardly as shown in FIG. 5, bellows 78** will make a barking noise simultaneously therewith.

In order to maintain the generally upright free-standing orientation of housing 14, a rear downwardly extending rear skid pad 88 is also provided. The center of gravity being rearwardly of the axis of wheels 32 because of the weight of push handle 16, the entire arrangement, whether the animal body 12 is attached or removed, will rest between wheels 32 and the rear skid pad 88 when laid to rest.

As may now be more fully understood, the level of body movement will vary with speed of propulsion. If a child wishes to enjoy a sedate walk, a slower speed of propulsion would accomplish this. Similarly, a brisk propulsion speed would induce more vigorous body movement, causing ears, legs and tail to move as if the puppy were running and jumping.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A propellable articulating animal toy comprising:

a flexible, pliable body simulating an animal having freely movable body components, said body components including a head with floppy ears and four legs;

a housing having at least one rotatable ground-engaging wheel mounted on an axle operably connected to rollably support said housing;

a longitudinally disposed elongated body articulating lever pivotally mounted about a transverse axis in said housing through a mid-point along said lever;

an exterior portion of said lever forwardly extending from said housing and said transverse axis;

an interior portion of said lever rearwardly extending into said housing and cooperably structured with said axle and wheel to be pivotally eccentrically articulated up and down through an acute angle below horizontal as said housing is rolled on said wheel across a flat surface;

said body structured to fit over and connect to said housing and a captured portion of said lever whereby a central point of said body is above said axis, said body loosely stuffed and configured and said ears and legs loosely attached to said body so that, as said lever articulates up and down, said ears and legs move freely and loosely flop with respect to said body;

said lever exterior portion articulating said body in up and down movement to impart a simulated walking/running/jumping motion to said body and said body components.

2. A propellable articulating animal toy as set forth in claim 1, wherein:

said body is detachable from said housing.

3. A propellable articulating animal toy as set forth in claim 2, further comprising:

an elongated rigid push handle connected to said housing and extending rearwardly and upwardly therefrom;

said push handle structured having a distal end for hand grasping and rollably propelling said housing over the flat surface.

4. A propellable articulating animal toy as set forth in claim 3, further comprising:

a flexible elongated simulated leash detachably connected at one end adjacent said push handle distal end and detachable connectable at the other end of said leash to a collar around a neck area of said body.

5. A propellable articulating animal toy as set forth in claim 4, further comprising:

a rear skid pad connected to and rearwardly and downwardly extending from said housing;

said skid pad structured to support said housing in cooperation with said wheel in a free-standing generally upright orientation.

6. A propellable articulating animal toy as set forth in claim 3, wherein:

said body head moves upwardly sufficiently for a user to see a face of said animal.

7. A propellable articulating animal toy as set forth in claim 1, further comprising:

bellow means for producing an audible repetitive sound simulating a particular animal sound, said repetitive sound occurring coincident with said up and down body movement of said lever.

8. A propellable articulating animal toy as set forth in claim 1, wherein:

said acute angle is in the range of about twenty to forty degrees, (20° to 40°).

9. A propellable articulating animal toy as set forth in claim 1, wherein:

said body is covered with long flexible plush simulating animal hair which bobs up and down in response to movement of said body to enhance realistic movement of said animal.

10. A propellable articulating animal toy as set forth in claim 1, wherein:

said lever articulates up and down approximately once per linear foot of horizontal rolling movement of said housing.

11. A propellable articulating animal toy as set forth in claim 1, wherein:

said lever interior portion is captured with respect to said axle.

* * * * *